US010583450B2

(12) United States Patent
Brugger

(10) Patent No.: US 10,583,450 B2
(45) Date of Patent: Mar. 10, 2020

(54) DOSING DISPENSER

(71) Applicant: Gerhard Brugger, Pflach (AT)

(72) Inventor: Gerhard Brugger, Pflach (AT)

( * ) Notice: Subject to any disclaimer, the term of this patent is extended or adjusted under 35 U.S.C. 154(b) by 0 days.

(21) Appl. No.: 16/392,365

(22) Filed: Apr. 23, 2019

(65) Prior Publication Data

US 2019/0321842 A1 Oct. 24, 2019

(51) Int. Cl.
*B05B 11/00* (2006.01)

(52) U.S. Cl.
CPC ..... *B05B 11/3084* (2013.01); *B05B 11/3015* (2013.01); *B05B 11/3016* (2013.01); *B05B 11/3073* (2013.01); *B05B 11/0037* (2013.01)

(58) Field of Classification Search
CPC ..... B05B 11/3084; B05B 11/3015; B05B 11/3016; B05B 11/3073; B05B 11/0073; B05B 11/0037
USPC ..... 222/380
See application file for complete search history.

(56) References Cited

U.S. PATENT DOCUMENTS 3,124,275 A * 3/1964 Lake ..... B05B 11/0027 222/182
3,187,960 A * 6/1965 Gorman ..... B05B 11/3023 222/321.9
3,628,704 A * 12/1971 Corsette ..... B65D 41/045 222/513
4,485,943 A * 12/1984 Czech ..... B05B 11/3015 222/256
4,796,786 A * 1/1989 Czech ..... B05B 11/0032 222/256
5,497,915 A 3/1996 Wass
5,622,282 A * 4/1997 Yazawa ..... B65D 83/38 222/105
6,021,924 A * 2/2000 Suck ..... B05B 11/3023 222/105
6,334,552 B1 * 1/2002 Bougamont ..... B05B 11/3001 222/341
6,488,185 B2 * 12/2002 Beranger ..... B05B 11/0013 222/385
7,059,499 B2 * 6/2006 Masuda ..... B05B 11/007 222/321.9
7,137,531 B2 * 11/2006 Arghyris ..... B05B 11/3023 222/94
7,240,808 B2 * 7/2007 Brugger ..... B05B 11/3083 222/135
7,510,101 B2 * 3/2009 Foster ..... B05B 11/3084 222/136
8,028,862 B2 * 10/2011 Rossignol ..... B05B 11/3004 222/256
8,038,036 B2 * 10/2011 Bruder ..... B05B 11/0067 222/189.09
9,668,562 B2 * 6/2017 Lee ..... A45D 34/04
10,086,394 B2 * 10/2018 Bruder ..... B05B 11/3084
(Continued)

OTHER PUBLICATIONS

DE search report, dated Dec. 17, 2018.

*Primary Examiner* — Patrick M. Buechner
*Assistant Examiner* — Michael J. Melaragno
(74) *Attorney, Agent, or Firm* — Lewis Brisbois Bisgaard & Smith LLP; Craig W. Mueller

(57) ABSTRACT

In a dispenser for dosing of at least one component received in a receiving compartment, a valve device, forming an inlet valve and an outlet valve associated with an outlet opening, is formed of at least two valve elements.

15 Claims, 9 Drawing Sheets

(56) References Cited

U.S. PATENT DOCUMENTS

2004/0129727 A1* 7/2004 Foster ..... B05B 11/3084 222/137
2006/0011659 A1* 1/2006 Greiner-Perth ..... B05B 11/3015 222/321.7
2006/0037974 A1* 2/2006 Brugger ..... B05B 11/3083 222/383.1
2006/0054633 A1* 3/2006 Brugger ..... B05B 11/0054 222/94
2006/0113325 A1* 6/2006 Foster ..... B05B 11/3084 222/137
2013/0075428 A1* 3/2013 Brugger ..... B05B 11/3011 222/136
2014/0054317 A1* 2/2014 Brugger ..... B05B 11/3083 222/135
2014/0061239 A1* 3/2014 Brugger ..... B65D 81/32 222/135
2014/0209644 A1* 7/2014 Socier ..... B65D 47/2031 222/494
2014/0346196 A1* 11/2014 Byeon ..... B05B 11/00416 222/256
2015/0001254 A1* 1/2015 Uehira ..... B05B 11/3001 222/321.9
2015/0014369 A1* 1/2015 Hatton ..... F16K 15/147 222/490
2015/0108173 A1* 4/2015 Kim ..... B05B 11/3015 222/321.8
2015/0151315 A1* 6/2015 Alluigi ..... B05B 11/3011 222/380
2015/0327730 A1* 11/2015 McNulty ..... A47K 5/14 222/1
2016/0144395 A1* 5/2016 Brugger ..... A45D 40/262 401/150
2016/0279653 A1* 9/2016 Brugger ..... B05B 11/0032
2017/0341097 A1* 11/2017 Brugger ..... B05B 11/3008
2018/0263359 A1* 9/2018 Kim ..... A45D 34/04

* cited by examiner

DOSING DISPENSER

This application claims the benefit of DE102018109815.4 filed with the German Patent and Trade Mark Office on Apr. 24, 2018, the entire disclosure of which is incorporated by reference herein.

FIELD OF THE INVENTION

Embodiments of the present invention relates to a dosing dispenser for dosing at least one component received in a receiving compartment by means of a pumping unit communicating therewith which may be actuated by means of a handle and comprising a piston, a cylinder, and a pumping chamber having at inlet and outlet openings closable by valves.

BACKGROUND AND SUMMARY OF THE INVENTION

Dosing dispensers are known, for example, from DE 202 07 029, DE 202 08 173 or DE 202007018065 going back to the applicant.

In the known dispenser the component to be discharged is sucked at a vacuum in the pumping chamber from the receiving compartment by an inlet valve into the pumping chamber that forms a compression chamber in the stroke between piston and cylinder. In case of opposite movement of the piston, i.e. a compression, the component is compressed and pressed out via an outlet valve and discharged toward an outlet at which the component is discharged to the outside of the metering dispenser.

Known dosing dispensers have a most delicate structure to manufacturing tolerances. The components forming the inlet and outlet valves are made of a relatively resilient material, for example, a thermoplastic elastomer manufactured in a separate manufacturing step and clamped between the component forming the cylinder and the housing. Due to the design of the valves, a very low swelling behavior of the components is required for the proper function of the valves, particularly of the resilient materials, which as a rule cannot be guaranteed with the partly aggressive elements of the component. Therefore, a secure dosing out of the component with the dosing dispenser by actuation of the handle can only be ensured in case of low swelling behavior of the sensible components and tight manufacturing tolerances.

It is assumed that a generic dispenser is to be formed with the present invention that can be produced more easily and the manufacture of which allows for greater tolerances and permits a higher swelling behavior of the components.

To solve this problem, a dispenser is proposed having the feature of claim 1 of the present invention. This differs from the generic prior art especially by a multi-part valve element, which forms a valve associated with an inlet opening and an outlet valve or exhaust valve associated with an outlet opening. Expedient embodiments of the invention are characterized by the features of the dependent claims.

The inlet and the outlet valve formed by a first and a third valve element are formed correspondingly of at least two components that preferably may be formed with an intermediate element in form of a plate spring. Due to this development, the complexity of the function of the individual parts is low and the input valve and the output valve may be designed with different individual materials and functions.

To improve the control of the flow of the component within the metering dispenser, especially in the compression of the piston and cylinder, it is proposed according to a preferred embodiment of the present invention to design the outlet valve by a valve disc, or a collar having a central bore hole, the bore hole being sealingly clamped between the intermediate member and the cylinder. This outlet valve leads to an annular channel which is usually formed by the outer peripheral surface of the cylinder. Accordingly, the collar preferably rests on the outer peripheral surface of the cylinder and sits on this outer peripheral surface in the closed position of the outlet valve. Below the abutment surface of the cylinder for the exhaust valve, the cylinder can be chamfered or beveled for favorable flow characteristics in order to optimally seal the outlet valve with the cylinder. Thus, the outlet valve and the cylinder are preferably formed as cylindrical members having a circular cross-sectional area.

According to another preferred embodiment of the present invention, it is proposed to mount the output valve at the end face of the cylinder with the intermediate element as the second valve element. The output valve as a third valve element and the intermediate element are correspondingly fixed within this dosing dispenser at the end face of the cylinder. Any type of fixing, for example a material-locking fixation by gluing or welding of the valve elements is conceivable.

According to a preferred embodiment of the present invention, which renounces such separate manufacturing steps for connecting the valve elements with housing parts of the dosing dispenser, the valve element is clamped as output valve between the cylinder and the intermediate element. The housing accommodates the pumping unit, is preferably connected with the pumping unit by means of welding, and supports moreover the receiving compartment for the component which can be latched with the housing. In order to clamp the outlet valve between the cylinder and the intermediate element, the intermediate element has preferably several radially encircling sealing rings that sealingly abut at the end face of the output valve.

The cylindrical opening in the center of the intermediate element serves particularly the objective to form a passage for the component flowing through the input valve. The component to be discharged flows first, if applicable past a locking plug, which is fixed to the housing, due to the lifting of the first valve, through the inlet valve into a valve chamber between the intermediate element and the input valve and then further through the opening in the intermediate element into the cylinder space of the pump. In addition, the output valve is centered by the cylindrical projection of the intermediate element and is fixed as a unit depending on the assembly process by a preferred undercut at this cylindrical projection of the intermediate element with intermediate output valve in the bore on the end face of the cylinder.

The first valve element as inlet valve is preferably formed similar to the outlet valve as disc which has a bore in the center. The bore is sealed in the closed position by means of a cylindrical element connected with the housing, something that, in one embodiment, for example takes place by a plug that is fixed with the housing, the first valve element abutting on the plug, so that in the pressure stroke (material discharge from the dispenser), the opening of the first valve element is closed. The input valve is resilient and due to this resilience, the inlet opening is released in the center by suction pressure. The free movement of the inlet valve is promoted in a preferred embodiment in which the inlet valve has a greater outer diameter and is clamped between the intermediate element and the housing, where the clamping region of the intermediate elements has a maximum diameter.

The inlet valve is preferably centered with the outer diameter in the housing and tightly connected with the intermediate element. In order to clamp the inlet valve between the housing and the intermediate element, the intermediate element preferably has several radially encircling sealing rings that tightly abut at the outlet valve.

The inlet valve can also be designed as gravely acting ball, particularly as a steel or glass ball, which seals on the housing and opens by lifting. In doing so the intermediate element is tightly connected with the housing and seals preferably between the outer diameter of the intermediate element and inner diameter of the housing.

In this embodiment of the inlet valve, webs are preferably mounted on the intermediate element as spacers to the ball so that the ball cannot seal at the intermediate element and so the component can flow unhindered into the pump.

As another embodiment of the input valve, a ball- or cone-shaped closure element is provided particularly in form of a plug which is for example formed by a plug at the side of the housing or by a plug disposed in the center of the inlet valve, the plug being supported by webs extending substantially in the circumferential direction and are outgoing in the exterior at an annular part of the inlet valve.

The sealing element can be pressed advantageously by the resilient force of the webs in the unpressurized state onto the sealing seat of the housing and hence closes on its own, i.e. automatically.

The radial or circumferential webs have accordingly a relatively small thickness. When opening the inlet valve, the closure element is raised from the sealing seat on the housing so that the inlet valve releases the inlet opening.

The overall cylindrical outer circumferential surface of the first valve element allows an easy assembly within the housing of the dosing dispenser. The inlet valve is tightly installed between the housing and the intermediate element.

In all embodiments, the intermediate element can be designed as a plate spring and can thus compensate manufacturing tolerances of the components. In addition, the circumferential sealing rings of the intermediate element can take up other manufacturing tolerances in combination with the resilient material of the output valves and depending also on the design of the input valve and the function of the valves without impairing or altering their function.

The valve elements are preferably made of plastic material, in particular of elastic plastic material, with the elasticity or hardness, respectively, being adjustable individually.

The valve element of the inventive dosing dispenser can be arranged in a very space-saving manner with good functionality and the dosing dispenser is thus further formed according to another preferred embodiment of the present invention in that at least two pumping chambers are provided, each discharging into an annular channel surrounding the respective cylinder which communicate with a central discharge channel.

Therefore, the inventive dosing dispenser can appropriately also be a two- or multi-chamber dosing dispenser having two or more receiving compartments for different components which are mixed together only when metering out the dosing dispenser. The mixing ratio is preferably metered by a handle as described in DE 202 07 029 or DE 202 08 173.

Finally, a dispenser is proposed with a further embodiment having a compact structure wherein the components to be discharged are only coming into contact shortly before bringing them out of the dosing device so that components achieving combinatorial effects which react with each other can be discharged by the dispenser without losing their effectiveness by a premature reaction.

The Summary of the Invention is neither intended nor should it be construed as being representative of the full extent and scope of the present invention. That is, these and other aspects and advantages will be apparent from the disclosure of the invention(s) described herein. Further, the above-described embodiments, aspects, objectives, and configurations are neither complete nor exhaustive. As will be appreciated, other embodiments of the invention are possible using, alone or in combination, one or more of the features set forth above or described below. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
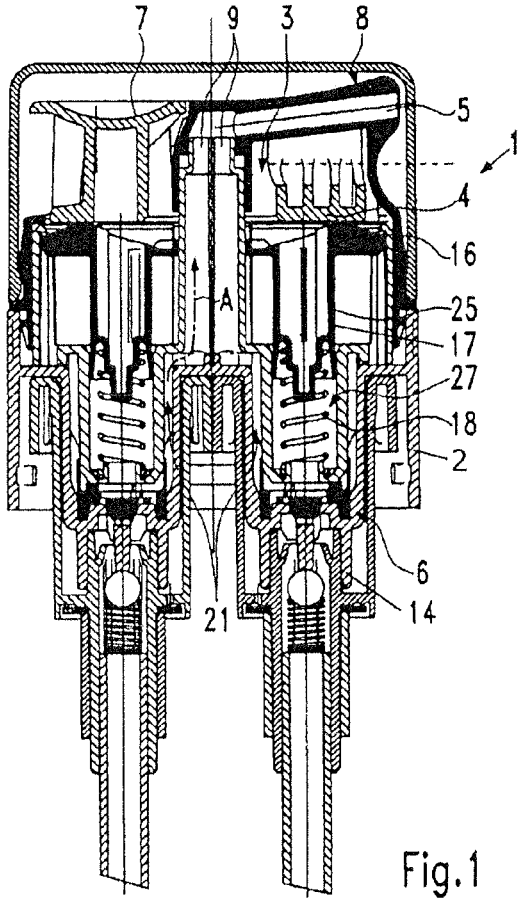
FIG. 1 is a longitudinal sectional view through the upper part of a dispenser according to state of the art.

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Based on FIGS. 1 to 5 the basic concept of the dosing dispenser 1 according to the state of the art is to be described first according to which the adjustment of the mixture by rotating of an actuating element 3 about the vertical axis with respect to a plurality of pumping units 6 takes place which are operated by the actuating element 3. Here, a pivot axis 4 is formed as a single piece or integrally at the actuating element 3 and is therewith adjustable together with it relative to a housing 2 (see also FIG. 2) and the pumping units 6. In the illustrated embodiment, the actuating element 3 is annular or disc-shaped so that this actuating element 3 is rotatable about a vertical axis and moreover pivotable about the pivot axis 4 arranged transversely thereto. The actuating element 3 lies with its underside on the two pumping units 6 so that by depressing the actuating element 3 about the pivot axis 4 a pumping stroke can be introduced to one or several pump pistons 25. This pivoting or depressing of the actuating element 3 about its pivot axis 4 is performed by a manually operable handle 7 which is provided at the edge of a housing head 8 mounted at the housing 2 in which an exit or a mixing nozzle 5 is also arranged for the mixture. Since lateral forces act here on the pumping piston 25, a collar 16 is provided each for their guidance. The collar 16 is guided rotationally fixed in at least one guide rail 12 at a mixing unit 11 and is therewith stably supported.

If the actuating element 3 is pressed or deflected downward by depressing the handle 7, it performs a pivoting movement about the pivot axis 4 so that only the pump head of the left pumping unit 6 in FIG. 1 is depressed. In this way, the left pump 6 here has a hub or a delivery volume of 100%. The pumping unit 6 on the right is not subjected to a force, since it is located below the pivot axis 4, has a hub or a flow volume of 0% (based on the total output quantity). Thus, the discharge contains only elements of the component discharged from the left pumping unit 6 via an annular channel 21 from the left receiving compartment, as this is indicated by the double-dot-dash arrow A within a discharge nozzle 9. Upon rotation of the actuating element 3 by 90°, an alignment of the pivot axis 4 is obtained in which it runs at a parallel distance from the connecting line of the two pumping units 6. If the actuating element 3 is pressed down starting from this position, the two pumping units are 6 pressed downward by the same distance so that both pumps have an identical hub or delivery volume of 50% of the total discharge. In the illustrated construction concept, the mixing unit 11 is formed as an annular hollow body with a multitude of stiffening ribs and also has the tower-like discharge nozzle 9 at its center, as is also apparent from FIG. 1.

As represented in FIG. 1, the housing 2 supports the rotatable housing head 8 at which the mixing nozzle 5 is formed as well. Through it, the mixture adjusted via the hub of the pumping unit 6 exits. The adjustment of the mixture is done by rotating the housing head 8 with respect to the housing 2.

Via connecting flanges at the housing 2, the receiving compartments can be attached for the components of the mixture, for example cartridges, glasses or bags. The components contained therein are guided via the central discharge nozzle 9 to the exit or mixing nozzle 5 that exits here radially from the housing head 8. In the receiving compartments spices, sauces, or detergents and the like may also be received in addition to cosmetics where it is essential that the pump piston 25 itself does not come into connection with the product. This is particularly advantageous for hygienic reasons.

The respective pumping units 6 with its pump pistons 25 engage after insertion into the guide rail 12 of the mixing unit 11 and the cylinder 27 formed by the housing so that there is a stable guidance. Furthermore, the pump piston 25 has at its lower end an integrally formed seal 17 whereby the number of components required for the pumping unit 6 is substantially reduced. In addition, a compression spring 18 may be inserted within the seal 17 and be stored therewith. Thus, a reliable guidance of the pump piston 25 is achieved particularly since, aside from the rotationally fixed guidance at the guide rail 12, the collar 16 annularly surrounds the upper end of the pump piston with a rounded point of contact toward the actuating element 3 and thus additionally reinforces the pump piston.

Figure 2:
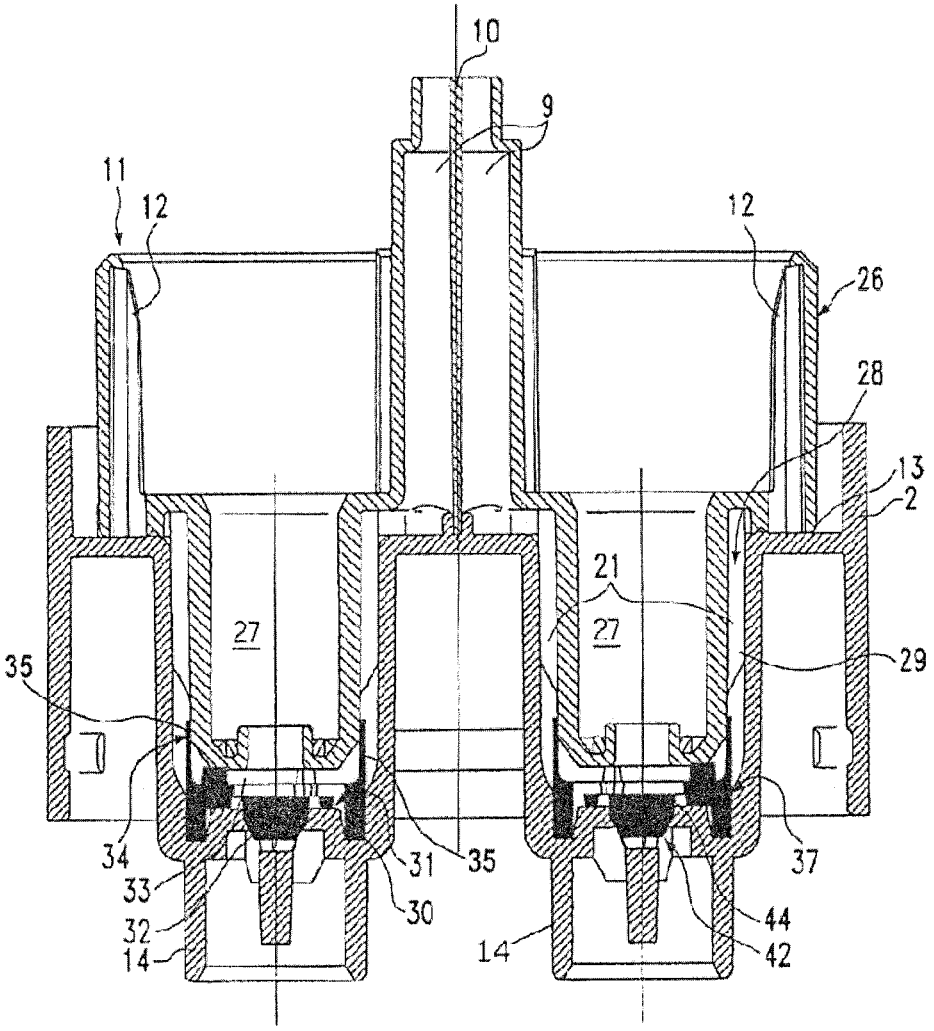
FIG. 2 is an enlarged representation of housing parts of a mixing unit according to FIG. 1.

FIG. 2 shows an enlarged view of the housing parts forming mixing unit 11. This is on the one hand about the housing 2 which can be connected to receiving compartments not shown. From above a pump housing 26 is inserted into this housing part 2 forming the two cylinders 27, which engage in the cylindrical recesses 28 of the housing 2 and are supported or guided there via radial spacer webs 29 that are distributed on the outer peripheral surface of the cylinder 27. A valve element 30 is located between the end face of the cylinder 27 and a bottom 31 of the recess 28. The valve element 30 is respectively located in a flow path which the component to be discharged takes from an anteroom formed within the extensions 14 to the annular channel 21. The component to be discharged arrives here via an inlet valve 32 into a valve chamber 33 and is output therefrom through the exhaust valve 34 in the direction of the annular channel 21.

Figure 3:
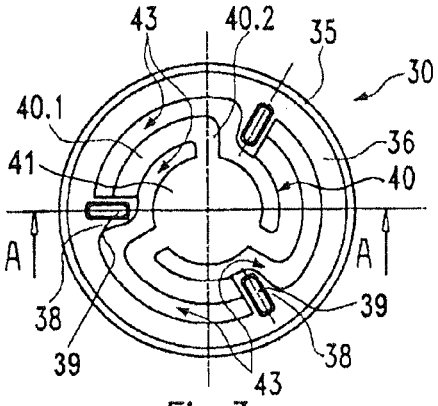
FIG. 3 is a plan view onto the known valve element shown in FIGS. 1 and 2.
Figure 4:
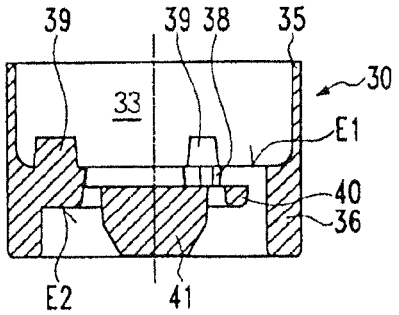
FIG. 4 an end view taken along the line A-A according to FIG. 3.

The valve element shown in detail 30 in FIGS. 3 and 4 has a cylindrical outer circumferential surface whose upper portion is formed by a collar 35 that forms the outlet valve 32 and abuts at the outer circumferential surface of the lower area of the cylinder 27 if the discharge valve is closed. The collar 35 is formed with a relatively low wall thickness so that the collar 35 can adjust itself resiliently outwards into the valve chamber 33 when compressing the component to be discharged. In any case, the collar 35 has a thinner wall than a fastener 36 continued as the cylindrical outer peripheral surface of the valve element 30 which engages into fastening receptacle 37 which is slightly chamfered on the inside and which is formed by the housing 2 in the area of the bottom 31. Between the fastener 36 and the exhaust valve 34, the valve element 30 forms projecting islands 38 from the inner circumferential surface whose top specifies a plane E1 surmounted by spacers 39 and the underside of which specifies a second plane E2. As can be seen in FIG. 4, three spacers 39 are distributedly provided on the inner periphery of the valve element 30. The spacers 39 are provided close to the edge, i.e. in the vicinity of the inner wall of the cylindrical collar 35 or of the annular fastening element 36. The islands 38 supporting the spacers 39 respectively are provided closely surrounding the spacers 39 and are thickened opposite the webs 40 which are supporting a plug 41 forming an inlet valve 32 which is provided centrally in the valve member 30 and sealingly abuts in its closed position at an inlet port 42 to the valve chamber 33 which is recessed in the bottom 31 of the housing 2. The webs 40 issue respectively from the associated islands 38 and extend strictly circumferentially from there at first. The first web portion 40.1 thus formed is followed by a second web portion 40.2 that combines the free end of the first web portion 40.1 with the plug 41. Between the bars 40 and the plug 41 on the one hand and the webs 40 and the inner circumferential surface of the fastening element 36 on the other hand flow passages 43 are recessed for the component to be conveyed. The bottom 31 of the housing 2 forms an abutment surface 44 at which the webs 40 and the islands 38 abut in the closed position of the inlet valve 32 in any case. The valve element 30 is clamped between the end face of the cylinder 27 and the abutment surface 44 and is fixed in axial direction. When the inlet valve 32 is open, the plug 41 lifts up together with the webs 40 from the abutment surface 44.

For assembly, the valve elements 30 are introduced into the respective cylindrical recess 28 of the housing and are inserted respectively with their fixing elements 36 in the fastening mounts 37. The plug 41 is conically enclosed at the front and is forced into the inlet port 41 due to the resilience of the webs 40. Thereafter, the pump housing 26 is inserted into the housing 2. In this case, the cylinders 27 chamfered at the face side are forced radially within the associated collar 35. The valve elements 30 are now firmly clamped between the end face of the cylinder 27 and the bottom 31. Thereafter, the pump housing 26 is welded at 13 with the housing 2. Thereafter, the pistons 25 may be mounted in the cylinder with the associated compression springs 18. A pre-assembled unit comprising the pump housing, the compression springs 18 and the plunger 25 as well as the other head-side elements of the dispenser may as well be inserted into the housing 2 and connected thereto.

Upon actuation of the handle 27, the component contained in the pumping chamber is at first compressed and discharged through the outlet valve 34. Here, the collar 35 expands radially outwardly so that the component arrives in the annular channel 21. From there, the component is guided into the central discharge nozzle 9 and from there to the mixing nozzle 5. When releasing the handle 27, the compression springs 18 return the pistons 25 into their starting position. Due to the vacuum, the inlet valve opens 32 so that the component can pass through the inlet port 42 into the valve chamber 33 and the displacement between the piston 25 and the cylinder 27.

Based on FIGS. 5 to 9, a preferred inventive embodiment of a dosing dispenser will be shown and described in which the valve element 30 according to FIGS. 1 to 5 is essentially replaced by a valve device 50 which is disposed between the cylinder 27 of the pump housing 26 and the bottom 51 (FIG. 5) at the end face of the housing 2 as in the embodiment according to FIGS. 1 to 5, analog as well to the arrangement according to FIG. 2.

It should be noted here that the inventive embodiments described in the following make essential use of the basic structure of the dosing dispenser according to FIGS. 1 to 5 so that the same components are provided with the same reference numbers. It should be particularly noted here that in FIG. 5 the sectional view is also led through the radial spacing webs 29 known from FIG. 2 according to state of the art such that the annular channels 21 delimited by the radial spacing webs 29 are not apparent which is, however, only due to the sectional view. For this reason, the annular channels 21, via which the discharged material is led via the discharge nozzle 9, are only drawn in FIG. 5 in the left representation of the cylinder 27 by hatching.

Figure 5:
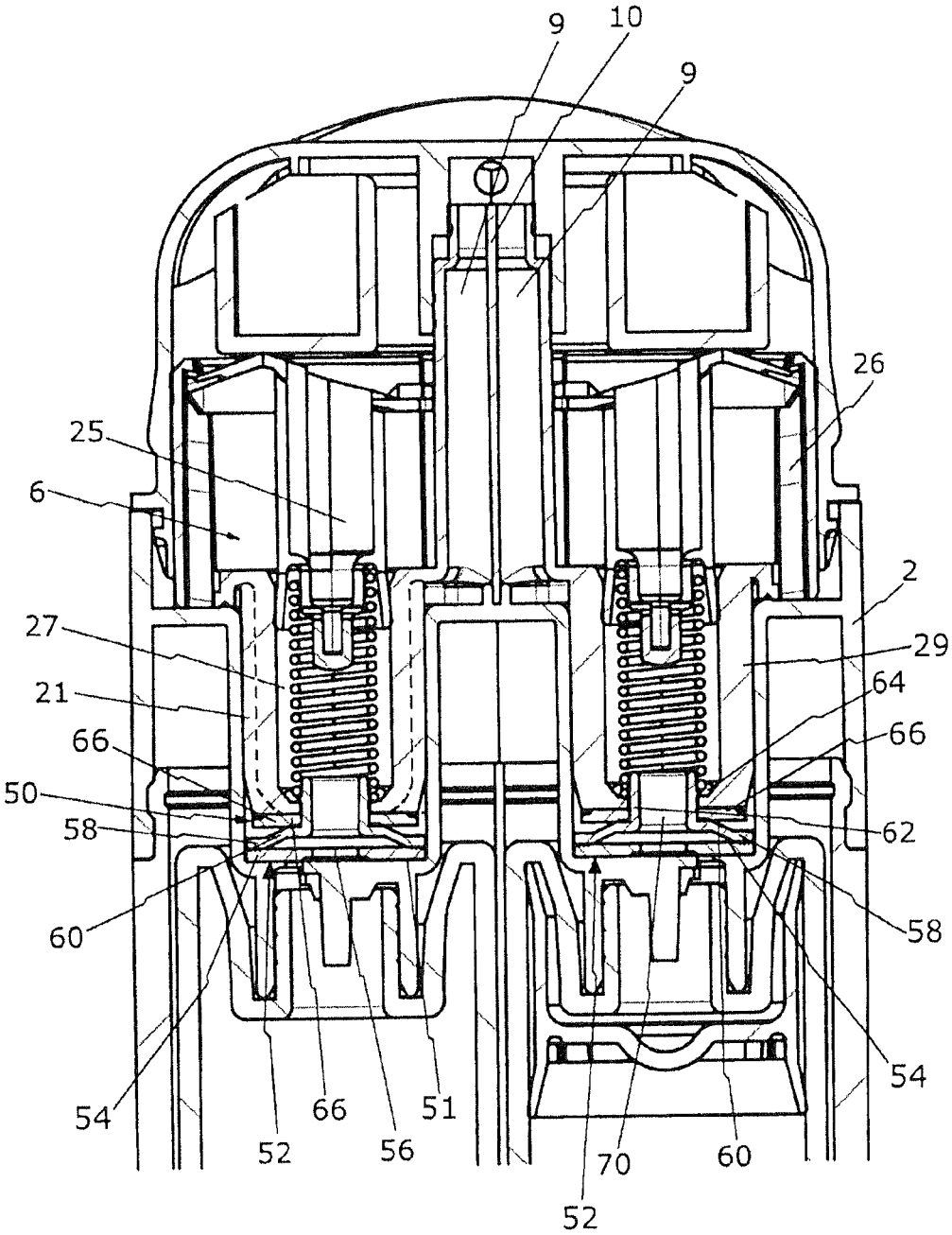
FIG. 5 is an enlarged representation of the upper part of an inventive embodiment of the dispenser according to the invention in sectional view.
Figure 7:
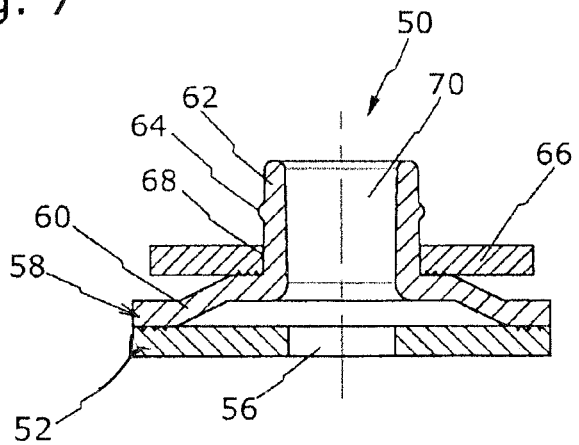
FIG. 7 is an extracted part from FIG. 5 which represents the inventive valve device in an alternative.

Different from the state of the art, the inventive valve device 50 is constructed in several pieces and in the represented embodiment, according to FIGS. 5 and 7, from a first valve element, which in the represented embodiment is exemplified by a sealing collar in form of a flat disc having a central opening 56 for the entry of material into the pump. As can be seen best from FIG. 5, the sealing collar extends appropriately as flat valve disc up to the housing 2 due to its great outer diameter and abuts the end face there.

A second valve element 58 is arranged above or on the first disc-shaped valve element 52, respectively, which preferably has an essentially trumpet-shaped cross-section according to FIGS. 5 and 7 and is formed of a circumferential collar 60 at which a cylindrical projection 62 connects centrally via which the second valve element is also specified and centered within the housing 2 in terms of the wall of the cylinder 27. A circumferential bead 64 (FIG. 7) serves as support for a spring of the pumping unit 6, as seen in FIG. 5, which pushes the piston of the pumping unit 6 which pushes the piston of the pumping unit 26, which had been pressed downward due to spring bias for the displacement stroke, upward for the intake stroke.

Above the collar 60 of the second valve element 58 there is a third valve element 66 of the valve device 50. In the preferred embodiment, this is again a flat valve disc with of a central opening 68 surrounding or enclosing the cylindrical projection 62. The cylindrical projection 62 also has a passage opening 70 inside. As can be seen in FIGS. 5 and 7, the radial dimension of the valve disc, which forms the valve element 66, is less than the outer diameter of the collar 60 of the second valve element 58, forming an intermediate member, and of the first valve element 52. Thus, as will be explained further below, access is made possible toward the annular channel 21 for material discharge to the applicator.

In the represented embodiment, the valve device 50, which, so to speak, forms the inlet and outlet valve, is a valve with three valve elements which allows to adjust individually and expediently the flexibility or hardness, respectively, of the valve elements which, according to FIGS. 1 to 5, was not possible in the valve design of the state of the art since this is an integral or one-part injection molded part with a relative complex structure. Due to this, the valve can be suitably adapted to specific cases of application.

Figure 8:
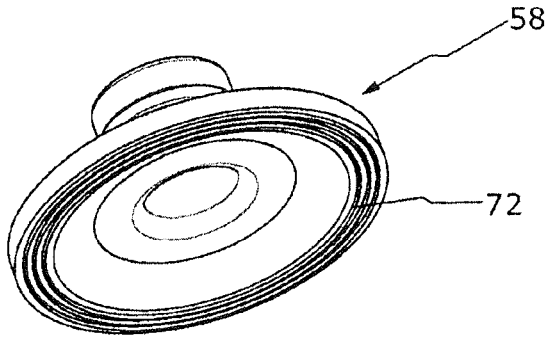
FIG. 8 is a perspective view of a valve element according to FIG. 7 in form of an intermediate element in perspective representation.
Figure 9:
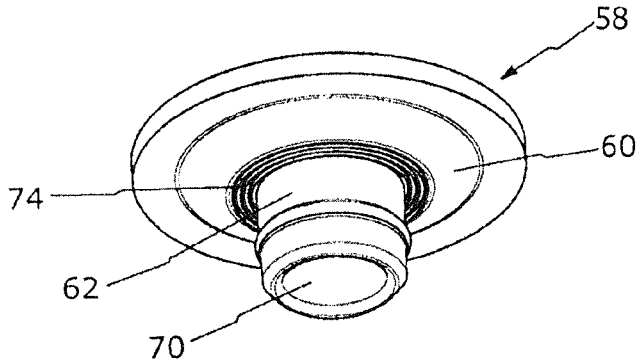
FIG. 9 is another perspective representation of the second valve element according to FIG. 8.

As can be seen in FIGS. 8 and 9, radial circumferential web-like sealing rings 72 are provided according to FIG. 8 at the lower side of the outer edge of the collar 60, that extends radially to the outside, which is, however, only appropriate and not mandatory. On the opposite side, the collar has comparable sealing rings 74 in the region around the cylindrical projection 62 as FIG. 9 shows. The rings 72 at the lower side of the collars 60, i.e. at the outer edge of the collar, lie on the first valve disc 54 and the sealing rings 74 at the top of the collar 60 abut at the lower side of the disc-shaped third valve element 66, whereby a reliable sealing between these three components can be achieved.

It should be noted that, as an alternative to the three-part valve device 50 represented, a two-part device may optionally be formed as well, i.e. the second valve element 58 and the third valve element 66 are produced as integral component which is equally within the scope of the invention. This is readily possible, for example, by two-component-injection molding, so that, which is preferred, the third valve disc 66 can be injected with a resilient flexible material and the second valve element 58 with a somewhat harder material and hence somewhat more rigid material. Nevertheless, it would then be about a one-part component formed from the second and third valve element so that the valve device 30 can be specified as two-part or three-part valve device 50 in the embodiment according to FIGS. 5 to 9.

Regarding the method of operation of the valve device 50, it applies that, if the piston 25 of the pumping unit 6 is pushed down in the cylinder 27, material in the cylinder 27 and therefore in the pumping chamber (which is defined by the cylinder 27) that had been sucked previously from the underlying container, is pressed past the outer side of the cylindrical projection. 62 into openings or radial slots, respectively, in or at the bottom of the cylinder, i.e. on the top of the disc-shaped third valve element 66, so that the material is led due to this clocking of the piston 25 into the annular channels 21 and from there to the exit nozzle 9 and hence to the applicator (here not represented). As can for example be seen in FIG. 5, in this case, the opening 56 is locked by a plug 54 which is fixed to the housing and on which plug the valve disc 52 abuts in a sealing manner in the discharge stroke. In the suction stroke, the inner ring section of the valve disc is risen as a result of the negative pressure, so that material can flow through between the plug 54 and the valve disc 52.

Figure 6:
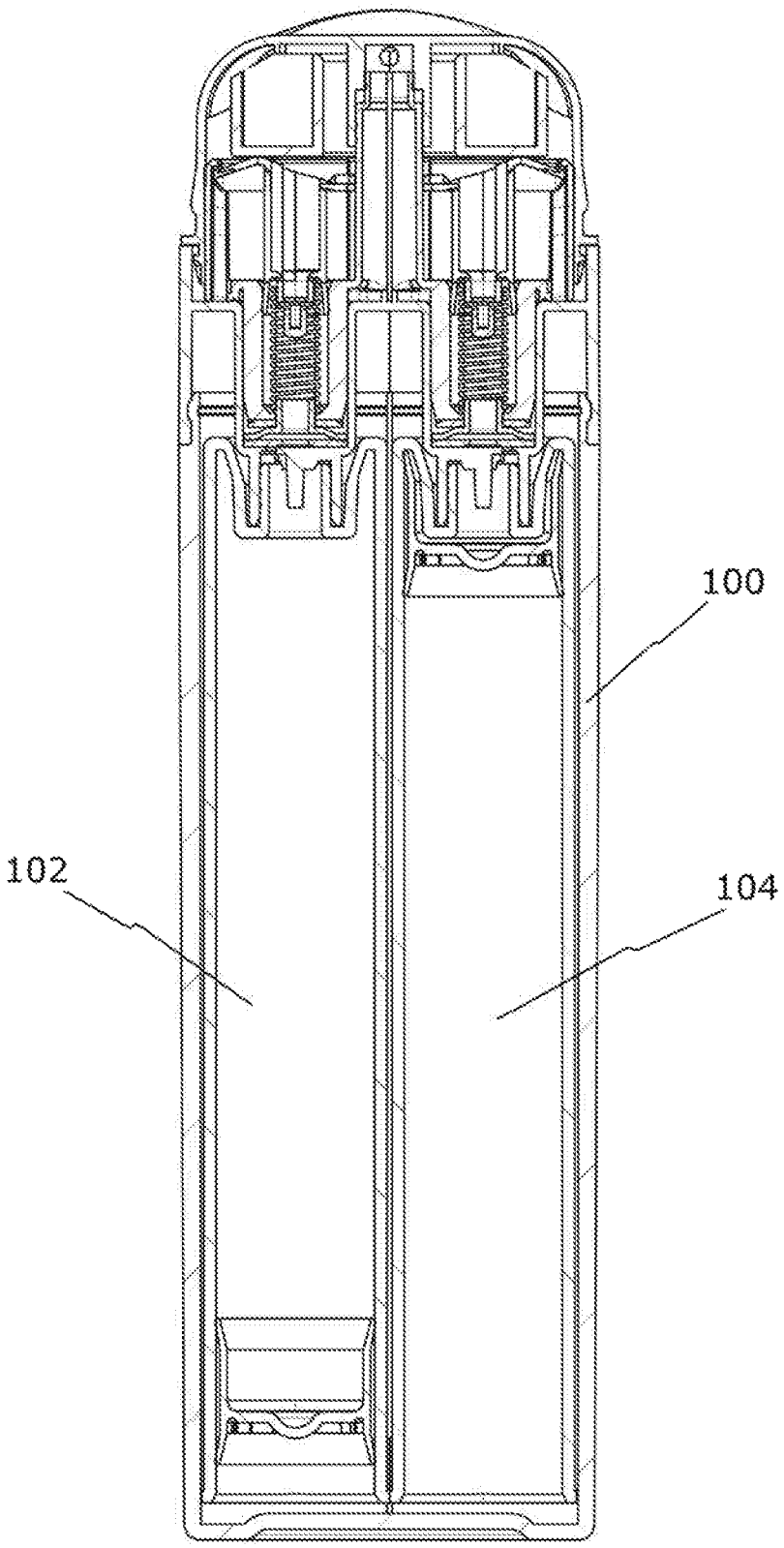
FIG. 6 is a sectional view of the entire dosing dispenser with the upper part according to FIG. 5.

The suction of the material from the containers, that are represented with 102 and 104 according to FIG. 6 in the form of cartridges and are accommodated in the housing 100, is carried out by the intake stroke of the piston 25 pushed upward by the springs, where due to the resulting negative pressure the disc-shaped first valve element 52 lifts up in the central region and hence material access is made possible to the central opening 56 and hence the material is led into the intermediate member having a preferably trumpet-shaped structure in form of the second valve element 58, i.e. to the cylinder 27. Hence, the material is available in the pumping chamber 27 for the next discharge stroke.

The great advantage of this design is that the valve device is comparatively simple in structure and manufacture and, moreover, the valve device may be adapted materially to the material to be discharged that as a rule is also chemically aggressive, depending on the application, and can lead to more or less pronounced swellings in the valve elements made of plastic. Hereby, using the design described, there results no impairment of the valve function by such swellings.

Figure 10:
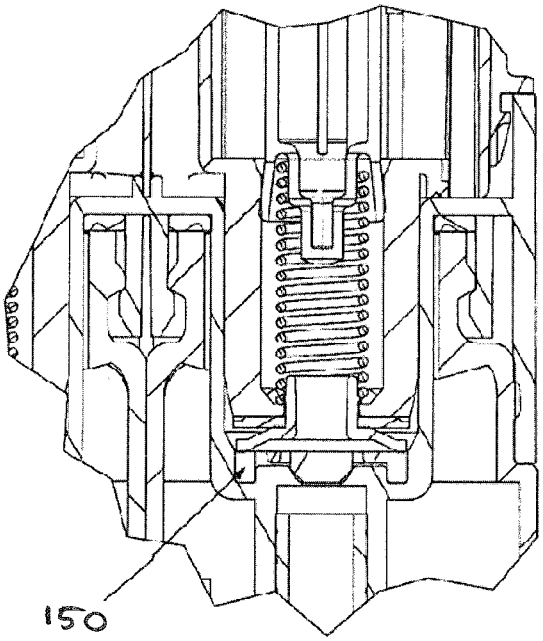
FIG. 10 is a partial view of the upper part of another alternative embodiment of the inventive dispenser for the representation of another valve device.
Figure 12:
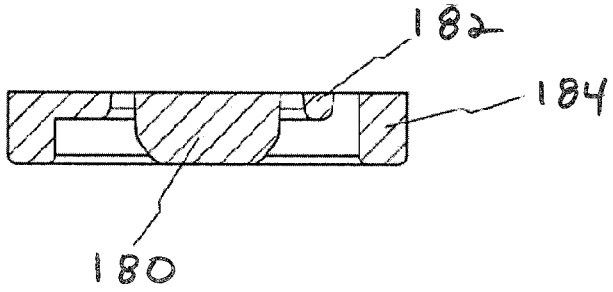
FIG. 12 is a sectional view through the first valve element according to FIG. 11.
Figure 13:
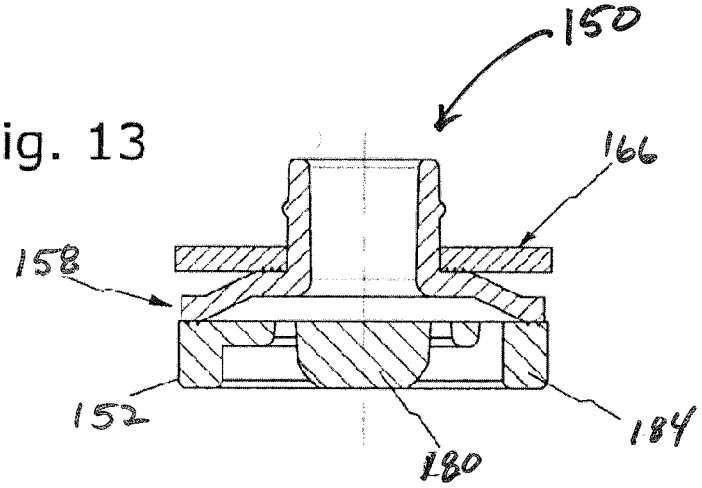
FIG. 13 is an extracted detail from FIG. 10 for the representation of the valve device according to FIG. 10.
Figure 15:
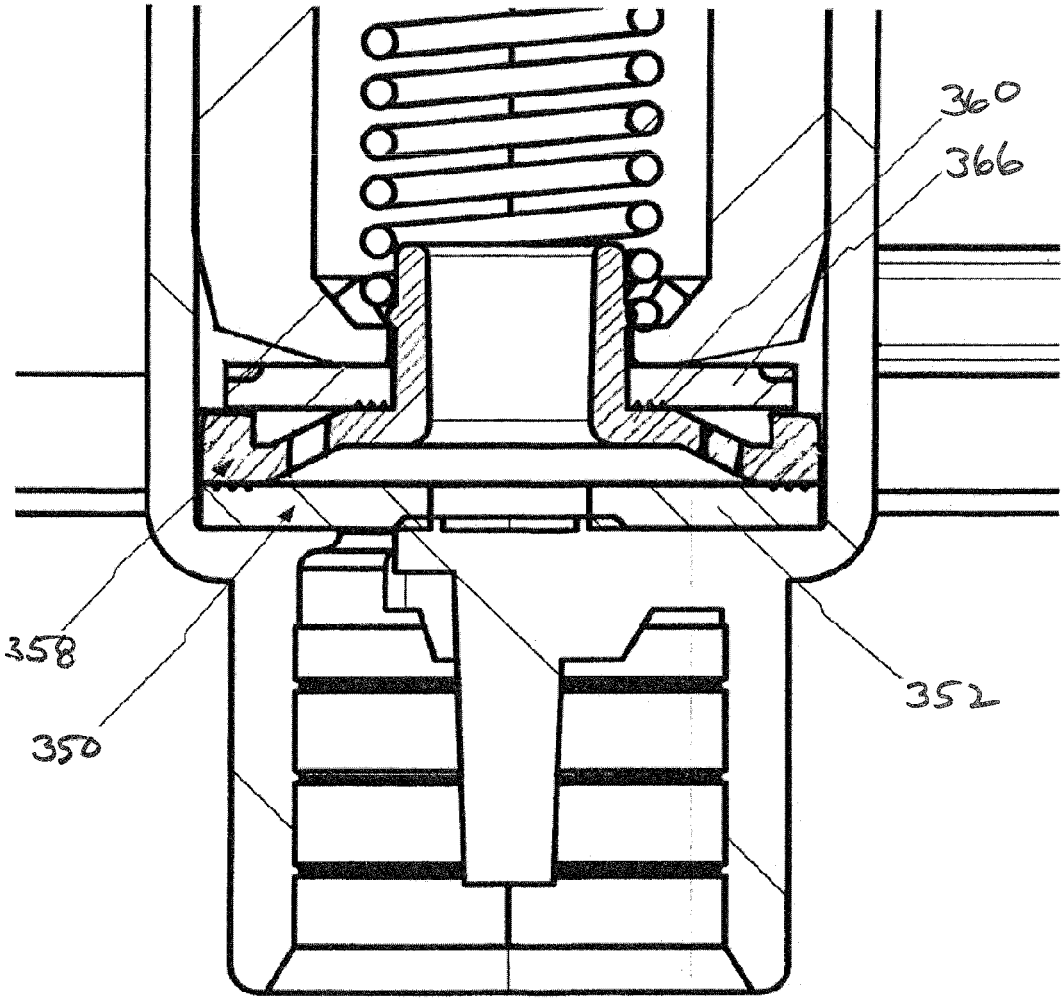
FIG. 15 is a partial view of another embodiment of an inventive valve device in a partial section through the dosing dispenser.

FIG. 10 shows an embodiment of a valve device 150 which is represented in detail in FIGS. 11 to 13 and may again be in two-piece or three-piece construction as in the preceding embodiment. This valve device 150 is also formed of three valve elements 152, 158 and 166 as in particular results from FIG. 13. The valve elements 158 and 166 are constructed here analog to the preceding embodiments according to FIG. 5 so that in the following only the modified first valve element 152 will be described.

Figure 11:
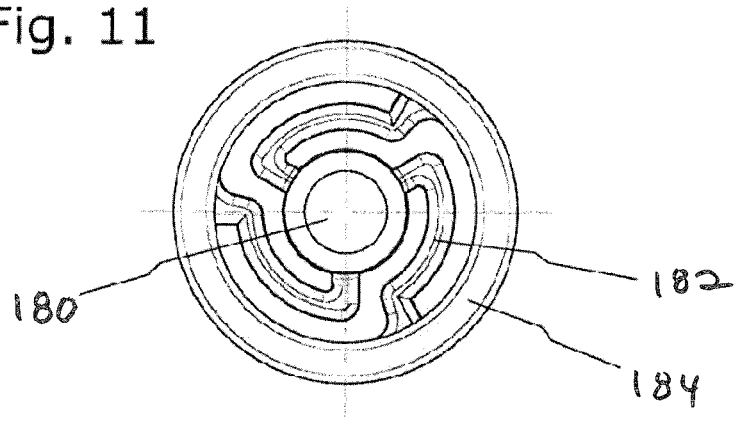
FIG. 11 is a plan view onto a first valve element of the valve device according to FIG. 10.

This has a central plug 180 that can be suspended at radial webs or, however, at curved webs 182 according to the embodiment of FIG. 11. The webs delimit between themselves the passage opening for the exit of the material or delivery of the material to cylinder 27, respectively, with an outer bead-like edge 184 of the first valve element 152. At the same time a resilient mounting results for the central plug 180 due to the represented web arrangement that is raised in case of an intake stroke and hence releases the delivery opening from the containers to the pumping unit so that material can be led toward the interior of the second valve element. In case the intake stroke is missing, the plug gets in closed position again by the spring webs 182. Due to the plug 180 which is integrated in the valve device 150, the plug according to FIG. 5 (see, reference number 54), which is fixed to the housing, is not necessary.

In the embodiment according to FIGS. 10 to 13, the outlet valve formed by the valve element 166 is constructed so that this valve is pushed down outside for material passage to the cylinder channels 21 (see, FIG. 5) and therewith opens. Via openings provided at the cylinder, particularly at the end face of the pump cylinder, material entry takes place into the annular channels. Insofar, the valve element 166 seals the pumping unit on the end face of the cylinder and is clamped inside between the end face of the cylinder 27 (see, FIG. 5) and the intermediate part, i.e. the second valve element 166.

Figure 14:
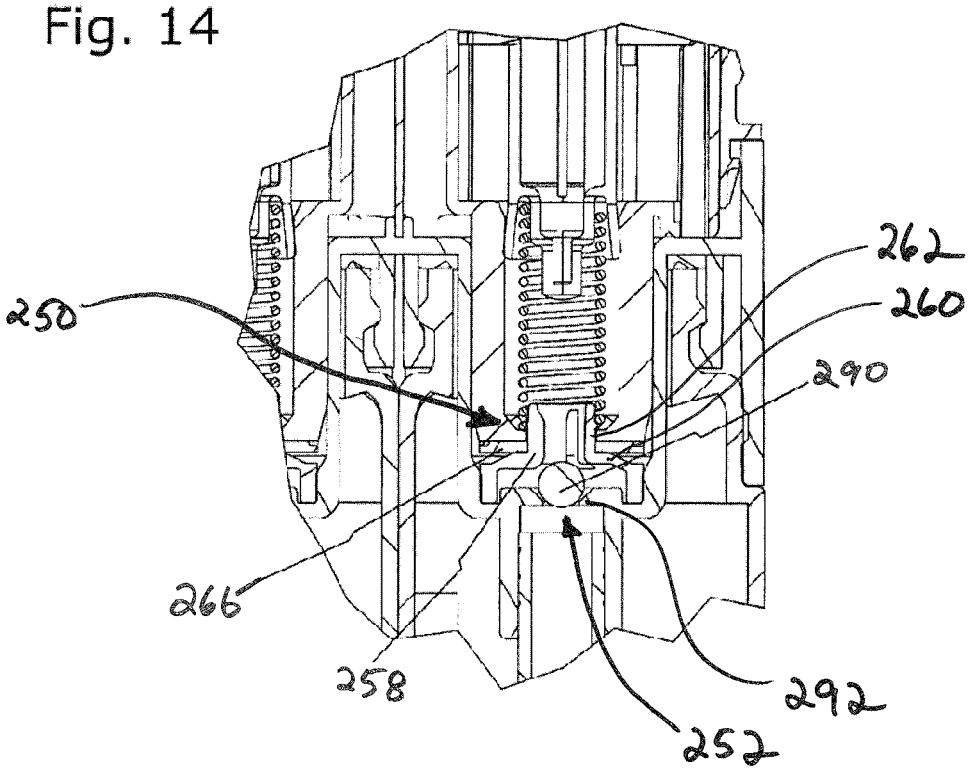
FIG. 14 is a partial view from the upper part of an inventive dispenser for the representation of another alternative of an inventive valve device with blocking ball.

In the other alternative embodiment according to FIG. 14, the first valve element is replaced by a blocking ball 290 which is located in the sealing seat 292 in the representation according to FIG. 14 and, hence, allows no access from the corresponding container. The blocking ball 290 is raised by the intake stroke so that an opening of the sealing seat is effected and the material may flow out of the respective container toward the cylinder 27, which defines the pump chamber according to both embodiments previously described. Expediently, the blocking ball 290 acts due to gravity, and the blocking ball 290 is appropriately made of metal, glass, or hard rubber, i.e. more solid materials than the remaining elements. This also results in a very simple structure of the two-part or three-part valve device. So to speak, the first valve element in this two-part or three-part valve device 250 forms the inlet valve of the dispenser and the third valve element 266 forms the outlet valve of the valve device 250. It should further be noted, that, if necessary, the valve device 250 may of course be also formed with more than three valve elements.

In the slightly modified version arising from FIGS. 15 to 18, the valve element 366 would open because this valve is bent upward at its outer edge and thus rises from the second valve element, so that in the pressure stroke, i.e. when ejecting, the material to be discharged gets between the third valve element 366 and the edge of the intermediate part to the ring chamber. In this embodiment there would be no radial webs or openings, respectively, in the cylinder of the pumping unit as there would be provided in the embodiment according to FIGS. 10 to 13 for material passage, but the trumpet-like designed intermediate member in form of the second valve element 358 is formed in the region of the collar 360 with openings 390 or by an annular opening with radial webs. Thus, during material suction, the material would flow from below through the openings 390 toward the third valve element 366 and hence would bend the valve element 366 upward so that a passage is created to the annular channels and hence to the applicator. In the pressure stroke, the third valve element 366 abuts on the intermediate part 358 in a sealing manner due to the negative pressure, particularly on the ring flange 392.

Figure 16:
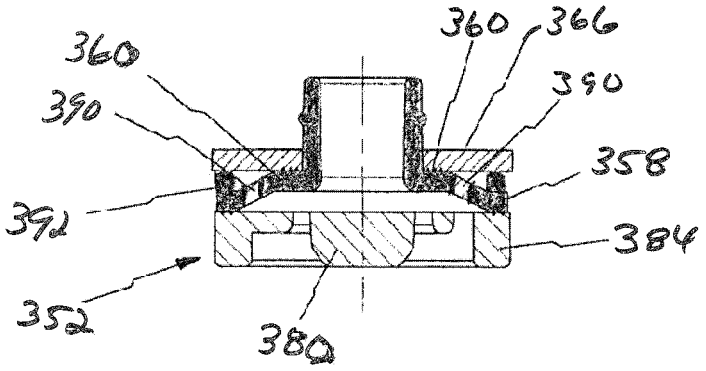
FIG. 16 is a sectional view of the valve device according to FIG. 15.
Figure 17:
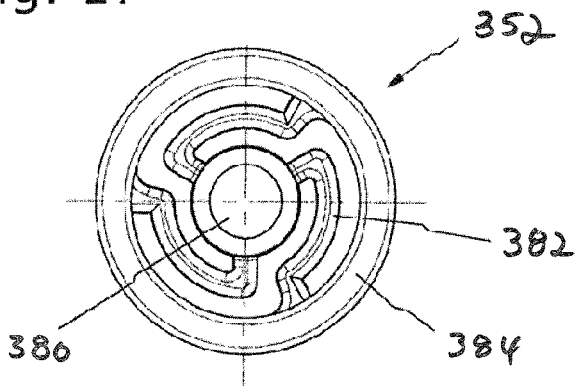
FIG. 17 is a plan view onto the first valve element of the valve device.
Figure 18:
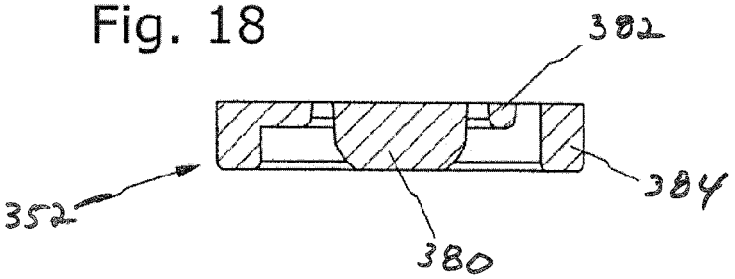
FIG. 18 is a sectional view of the first valve element of the valve device according to FIGS. 15 and 16.

As can be taken very clearly from FIG. 16, for sealing between the third valve element 366 and the second valve element 358, there is a notably bead- or flange-like annular web 392 directed upwards at the peripheral edge, the upper end face of which sealingly abuts at the lower side of the third valve element 366. Insofar the outlet valve 366 is sealed to the intermediate part 358 via the elevated sealing edge in form of an annular flange 392. This embodiment is not only provided as an alternative to the embodiment according to the FIGS. 10 to 13 but may also be applied in analogy to the two other versions so that there results a number of possibilities to combine inlet valve and outlet valve.

While various embodiments of the present invention have been described in detail, it is apparent that modifications and alterations of those embodiments will occur to those skilled in the art. It is to be expressly understood that such modifications and alterations are within the scope and spirit of the present invention, as set forth in the following claims. Further, it is to be understood that the invention(s) described herein is not limited in its application to the details of construction and the arrangement of components set forth in the preceding description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. A dosing dispenser for the dosage of at least one material component received in a receiving compartment by means of a pumping unit connected therewith, comprising:

a cylinder that defines a pumping chamber having inlet and outlet openings;

a piston configured to selectively move within the pumping chamber;

a container configured to hold material interconnected to the pumping chamber, wherein material from the container is adapted to travel through the pumping chamber upon selective actuation of the piston; and a valve device comprising:

a first valve element that selectively closes an access opening from the container, the first valve element having an opening that selectively allows material passage from the container to the pumping chamber, second valve element defined by a collar having a cylindrical projection extending therefrom that defines a passage opening that communicates with the opening of the first valve element, the second valve element disposed on the first valve member, and a third valve element disposed on the second valve element that sealingly engages the cylindrical projection of the second valve element.

2. The dosing dispenser according to claim 1, wherein the second and third valve element is one piece.

3. The dosing dispenser according to claim 1, wherein the material of the first valve element, the second valve element, and the third valve element are individually adjustable in terms of resilient flexibility or hardness.

4. The dosing dispenser according to claim 1, wherein the first valve element is a flat valve disc made of elastic material.

5. The dosing dispenser according to claim 4, wherein the first valve element is interconnected to the second valve element, wherein an outer portion of the collar engages an outer portion of the first valve element such that an outer edge of the first valve element and an outer edge of the collar engage the side wall of the pumping chamber to form the outlet valve of the valve device, wherein the interconnection of the second valve element to the first valve element allows an inner portion of the first valve element to move, while constraining the outer portion of the first valve element.

6. The dosing dispenser according to claim 5, wherein the outlet valve selectively opens a flow channel between an upper end face of the first valve element and the bottom of the pumping chamber when the plunger is pulled from the pumping chamber, and wherein the flow channel is in communication with an annular channel that is in communication with a discharge nozzle.

7. The dosing dispenser according to claim 1, wherein the collar possesses a trumpet-shaped cross-section, and further comprising a circumferential bead extending from the cylindrical projection configured to support a biasing spring associated with the piston of the pumping unit.

8. The dosing dispenser according to claim 1, wherein the outer diameter of the first and second valve elements is greater than the outer diameter of the third valve element, where the outer edge of the first and second valve elements abuts the inner wall of the pumping chamber.

9. The dosing dispenser according to claim 1, wherein the second valve element is formed at its upper or lower side with web-like radially encircling sealing rings.

10. The dosing dispenser according to claim 7, wherein the second valve element seals with the third valve element via a flange-like annular web provided at an internal peripheral edge of the collar that is adjacent to the cylindrical protrusion that engages a lower side of the third valve element, and wherein the collar has apertures for the material passage toward a lower side of the third valve element.

11. The dosing dispenser according to claim 1, wherein the third valve element is formed as a planar valve disc with a central opening which sealingly engages the cylindrical projection of the second valve element.

12. The dosing dispenser according to claim 1, wherein the first valve element is provided with a central sealing plug suspended with radial or circumferential webs associated with an outer marginal bead.

13. A dosing dispenser for the dosage of at least one material component received in a receiving compartment by means of a pumping unit connected therewith, comprising:

a cylinder that defines a pumping chamber having inlet and outlet openings;

a piston configured to selectively move within the pumping chamber;

a container configured to hold material interconnected to the pumping chamber, wherein material from the container is adapted to travel through the pumping chamber upon selective actuation of the piston; and a valve device comprising:

a first valve element that selectively closes an access opening from the container, the first valve element formed as a gravity-actuated blocking ball, second valve element defined by a collar having a cylindrical projection extending therefrom that defines a passage opening that receives the blocking ball when the plunger is moved from the pumping chamber, which also opens the first valve element, and a third valve element disposed on the second valve element that sealingly engages the cylindrical projection of the second valve element, wherein the cylindrical projection extends through the second valve element.

14. The dosing dispenser according to claim 13, wherein the blocking ball is formed of metal, glass, or hard rubber.

15. The dosing dispenser according to claim 13, wherein the collar has bridging radial webs or a cage blocking access of the blocking ball in the upward direction.

* * * * *